US011071434B2

(12) United States Patent
Shintani

(10) Patent No.: US 11,071,434 B2
(45) Date of Patent: Jul. 27, 2021

(54) CLEANING HEAD AND CLEANING TOOL

(71) Applicant: DAIO PAPER CORPORATION, Shikokuchuo (JP)

(72) Inventor: Naoki Shintani, Shikokuchuo (JP)

(73) Assignee: DAIO PAPER CORPORATION, Ehime (JP)

( * ) Notice: Subject to any disclaimer, the term of this patent is extended or adjusted under 35 U.S.C. 154(b) by 234 days.

(21) Appl. No.: 16/338,425

(22) PCT Filed: May 23, 2017

(86) PCT No.: PCT/JP2017/019109
§ 371 (c)(1),
(2) Date: Mar. 29, 2019

(87) PCT Pub. No.: WO2018/061305
PCT Pub. Date: Apr. 5, 2018

(65) Prior Publication Data

US 2020/0029776 A1 Jan. 30, 2020

(30) Foreign Application Priority Data

Sep. 30, 2016 (JP) ..... JP2016-192647

(51) Int. Cl.
*A47L 13/256* (2006.01)
*A47L 13/44* (2006.01)

(52) U.S. Cl.
CPC ..... *A47L 13/256* (2013.01); *A47L 13/44* (2013.01)

(58) Field of Classification Search
CPC ..... A47L 13/256; A47L 13/44; A47L 13/24; A47L 13/254
See application file for complete search history.

(56) References Cited

FOREIGN PATENT DOCUMENTS

| | | | |
|---|---|---|---|
| JP | 02119152 | U | 9/1990 |
| JP | H06311954 | A | 11/1994 |
| JP | H0713633 | Y2 * | 4/1995 |
| JP | 2013034766 | A | 2/2013 |

(Continued)

OTHER PUBLICATIONS

Chinese Office Action (and English language translation thereof) dated Aug. 28, 2020 issued in Chinese Application No. 201780057537.3.

(Continued)

*Primary Examiner* — Shay Karls
(74) *Attorney, Agent, or Firm* — Holtz, Holtz & Volek PC

(57) ABSTRACT

A cleaning head onto which a cleaning sheet for wiping a surface to be cleaned is attached is moved on the surface to be cleaned in a predetermined direction for wiping the surface to be cleaned. The cleaning head includes a first member on a side facing the surface to be cleaned and a second member arranged to abut on the first member at least partially on an opposite side of the surface to be cleaned. The second member is a member relatively more rigid than the first member. The second member has a protrusion part protruding toward the side of the first member more than the edge in the moving direction of the cleaning head. A surface of the first member on the side facing the surface to be cleaned is formed in a plane shape. The first member has a recess part which fits the protrusion part.

20 Claims, 7 Drawing Sheets

(56) References Cited

FOREIGN PATENT DOCUMENTS

| | | | |
|---|---|---|---|
| JP | 2013074962 | A | 4/2013 |
| KR | 20090005930 | U | 6/2019 |

OTHER PUBLICATIONS

International Preliminary Report on Patentability (IPRP) dated Apr. 2, 2019 (and English translation thereof) in counterpart International Application No. PCT/JP2017/019109.
Japanese Office Action dated Jun. 20, 2017 (and English translation thereof) issued in Japanese Application No. 2016-192647.
International Search Report (ISR) dated Jul. 11, 2017 issued in International Application No. PCT/JP2017/019109.
Written Opinion dated Jul. 11, 2017 issued in International Application No. PCT/JP2017/019109.
Chinese Office Action (and English language translation thereof) dated Mar. 19, 2021 issued in Chinese Application No. 201780057537.3.

* cited by examiner

CLEANING HEAD AND CLEANING TOOL

TECHNICAL FIELD

The present invention relates to a cleaning head for removing dusts and dirt on a surface to be cleaned and a cleaning tool with the cleaning head.

BACKGROUND ART

Conventionally, there have been known cleaning tools which remove dusts and dirt on the surface to be cleaned by wiping of the surface to be cleaned such as a floor with a head part which is connected to a stick to be gripped by a user and onto which a cleaning sheet is attached to catch the dusts and dirt.

Such cleaning tools preferably have a head part with a plane bottom surface so that the contact area between the cleaning sheet and the surface to be cleaned is larger. However, the planar shape of the bottom surface of the head part makes it difficult to remove dirt stuck to the surface to be cleaned.

Against that problem, there have been known cleaning tools which have an elastically deformable head part with a bottom surface, the center part of which curves to protrude downward (to the side of the surface to be cleaned) and forms a plane surface when being pressed to the side of the surface to be cleaned (ex. see Patent Document 1).

CITATION LIST

Patent Literature

Patent Document 1: Japanese Patent Application Laid Open Publication No. 2013-034766

SUMMARY OF INVENTION

Technical Problem

However, in above-referenced Patent Document 1, as the cleaning tool is moved on the surface to be cleaned like a mop in a predetermined direction in the state where pressure is added to the cleaning tool so that the bottom surface of the head part is made plane, the edge of the bottom surface in the moving direction of the head part is mainly used for removing dusts and dirt on the surface to be cleaned. Accordingly, the inward (closer to the center) part of the bottom surface of the head part, which is not the peripheral part, does not contribute to removal of dusts and dirt and the efficiency in cleaning of the surface to be cleaned may be decreased.

An object of the present invention is to provide a cleaning head and a cleaning tool which enable efficient cleaning of the surface to be cleaned even when pressed to the side of the surface to be cleaned.

Solution to Problem

In order to solve the above problems, according to an aspect of the present invention, a cleaning head is provided onto which a cleaning sheet for wiping a surface to be cleaned is attached and which is moved on the surface to be cleaned in a predetermined direction for wiping the surface to be cleaned, the cleaning head including:

a first member arranged on a side facing the surface to be cleaned; and a second member arranged to abut on the first member at least partially on an opposite side of the surface to be cleaned, wherein the second member is a member relatively more rigid than the first member, wherein the second member has a protrusion part on an upstream side of an edge of a part abutting on the first member in a moving direction of the cleaning head, the protrusion part protruding toward the side of the first member more than the edge in the moving direction of the cleaning head, wherein a surface of the first member on the side facing the surface to be cleaned is formed in a plane shape, and wherein the first member has a recess part which fits the protrusion part on an upstream side of an edge of a part abutting on the second member in the moving direction of the cleaning head.

According to another aspect of the present invention, the cleaning head is moved to and fro in one direction and in an other direction opposite to the one direction on the surface to be cleaned for wiping the surface to be cleaned, (a part of) the second member protrudes toward the side of the first member more than both edges of the part abutting on the first member to form the protrusion part between the both edges in a to-and-fro moving direction, and the first member has the recess part formed between the both edges in the to-and-fro moving direction at the part abutting on the second member.

According to another aspect of the present invention, the cleaning head is moved in a direction almost the same as a shorter direction which is almost perpendicular to a longer direction of the cleaning head for wiping the surface to be cleaned, the second member has the protrusion part between both edges of the part abutting on the first member in the shorter direction, and the first member has the recess part between the both edges of the part abutting on the second member in the shorter direction.

According to another aspect of the present invention, the cleaning head is moved in the direction almost the same as the longer direction for wiping the surface to be cleaned, the second member has the protrusion part between both edges of the part abutting on the first member in the longer direction, and the second member has the recess part between the both edges of the part abutting on the first member in the longer direction.

According to another aspect of the present invention, the first member is configured to be detachably attached to the second member.

According to another aspect of the present invention, a length by which the protrusion part protrudes is configured to be adjustable.

And according to another aspect of the present invention, a cleaning tool is provided which includes the above-described cleaning head and a stick connected to the cleaning head on an opposite side of the surface to be cleaned.

Advantageous Effects of Invention

The present invention enables efficient cleaning of the surface to be cleaned even when the cleaning tool is pressed to the side of the surface to be cleaned.

DESCRIPTION OF EMBODIMENTS

Hereinafter, specific embodiments of the present invention are described with reference to the drawings. The scope of the invention is not limited to the illustrated examples.

Figure 1:
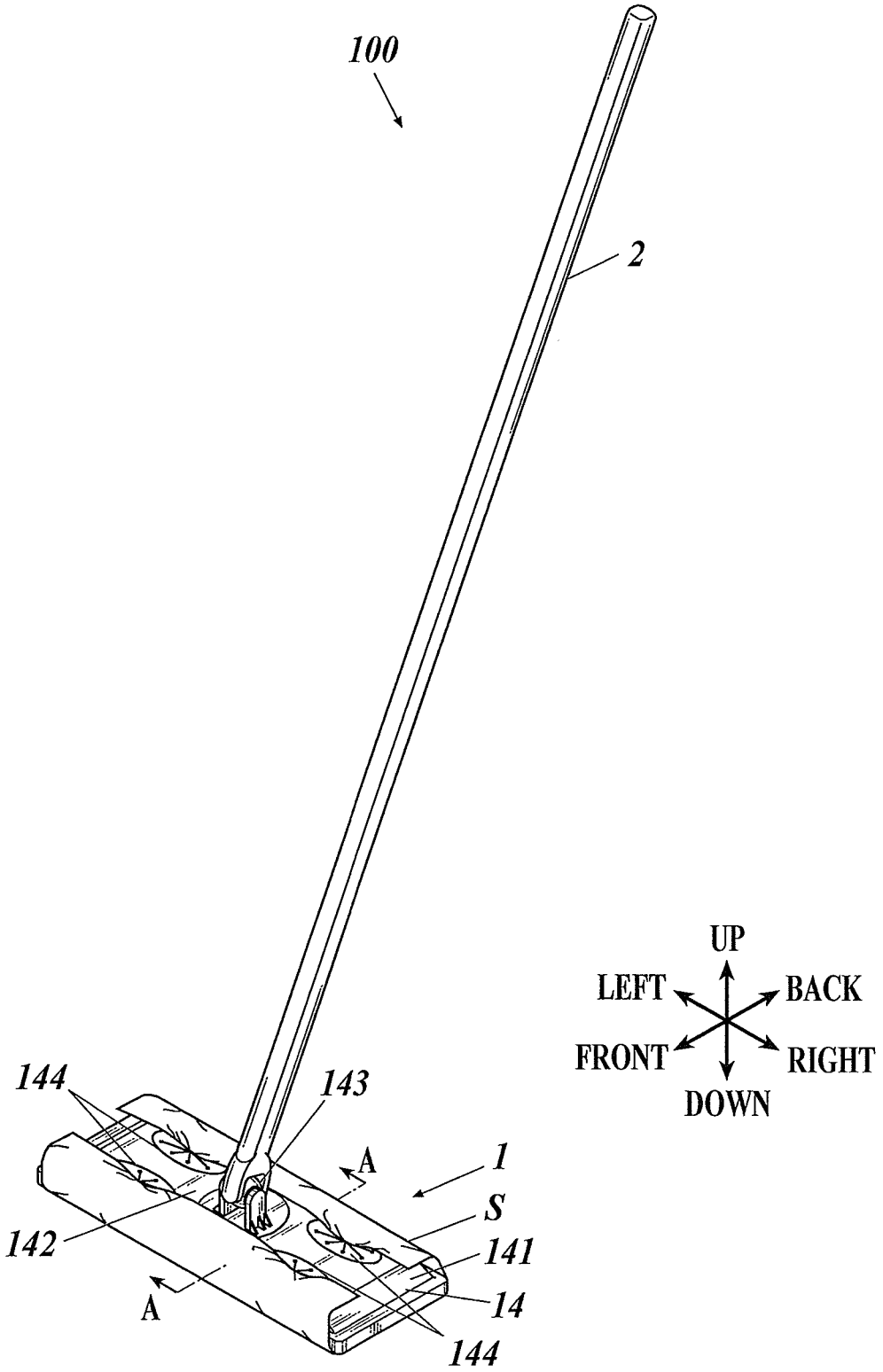
FIG. 1 shows a perspective view of a cleaning tool in an embodiment in accordance with the present invention.

FIG. 1 shows a perspective view of the cleaning tool 100 in an embodiment in accordance with the present invention.

The cleaning tool 100 is used for cleaning to remove dusts and dirt on a surface F to be cleaned (see FIG. 2A) such as a floor, for example. Specifically, as shown in FIG. 1, the cleaning tool 100 is configured such that a cleaning head 1 onto which a cleaning sheet S for wiping the surface F to be cleaned may be attached is connected to a stick 2 which is gripped by a user.

<Cleaning Head>

The cleaning head 1 is described in detail with reference to FIGS. 2A to 3B.

Figure 2A:
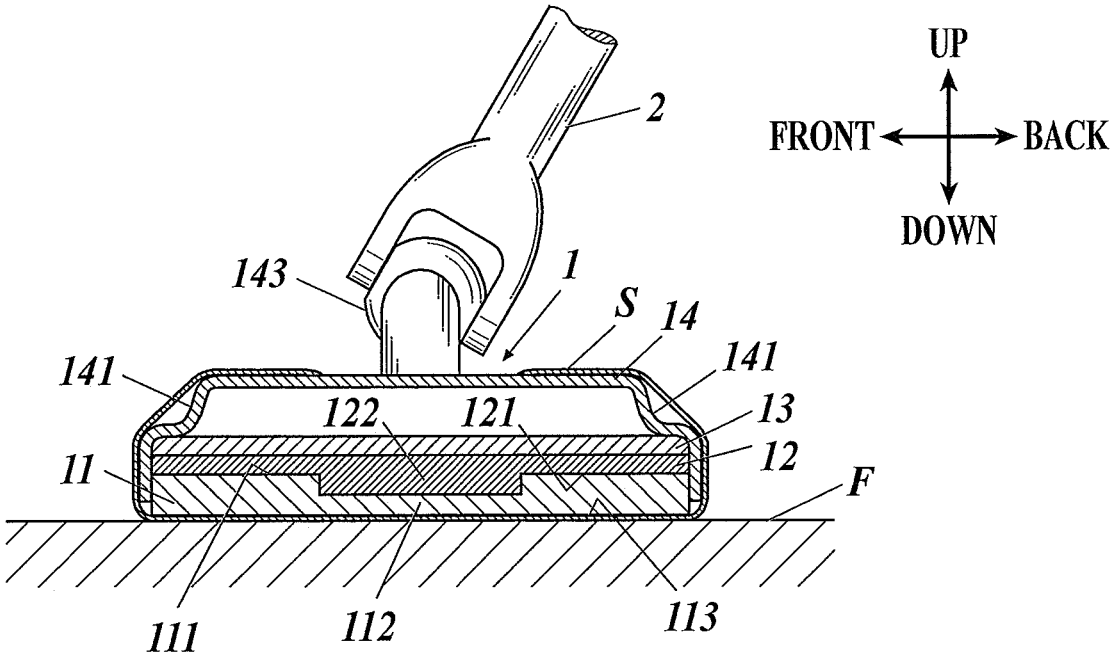
FIG. 2A is an explanatory drawing of a cleaning head of the cleaning tool in FIG. 1.
Figure 2B:
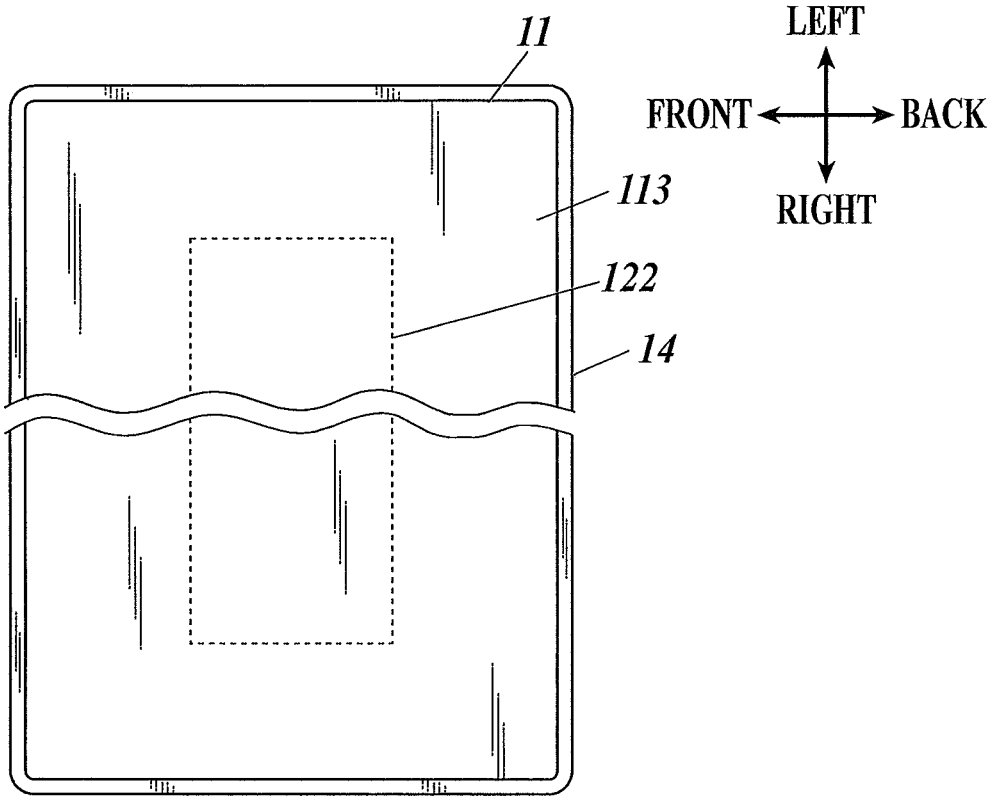
FIG. 2B is an explanatory drawing of the cleaning head of the cleaning tool in FIG. 1.

FIG. 2A shows a cross-sectional view of the cleaning head 1 along line A-A of FIG. 1. FIG. 2B is a schematic drawing of the cleaning head 1 viewed from the bottom side. An illustration of the cleaning sheet S is omitted in FIG. 2B.

Figure 3A:
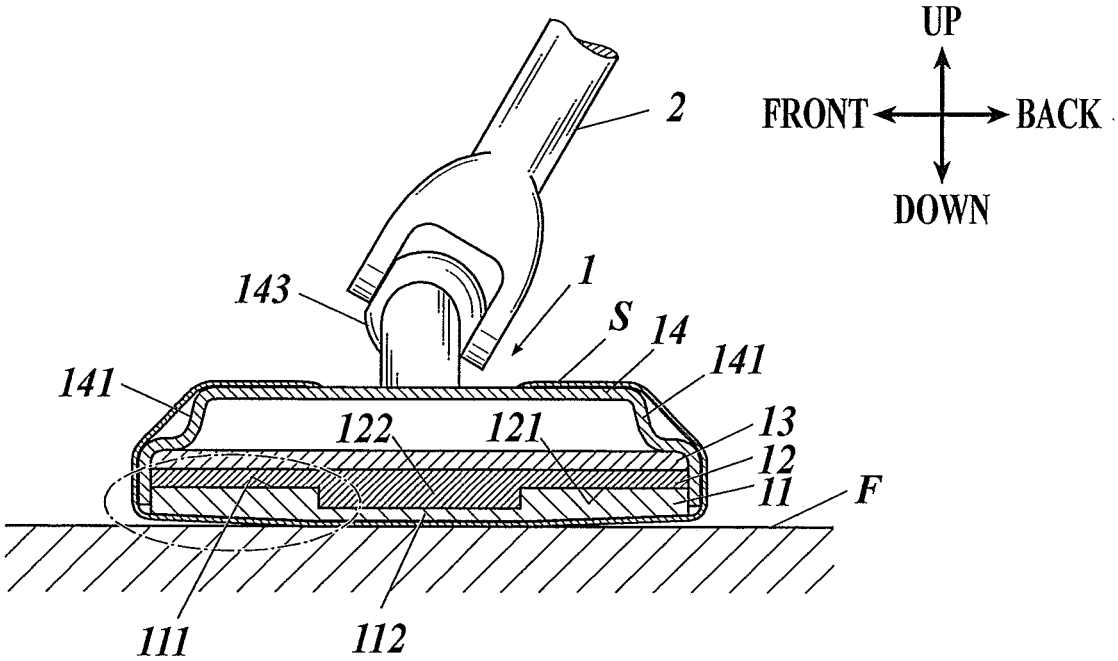
FIG. 3A is an explanatory drawing of the cleaning head of the cleaning tool in FIG. 1.
Figure 3B:
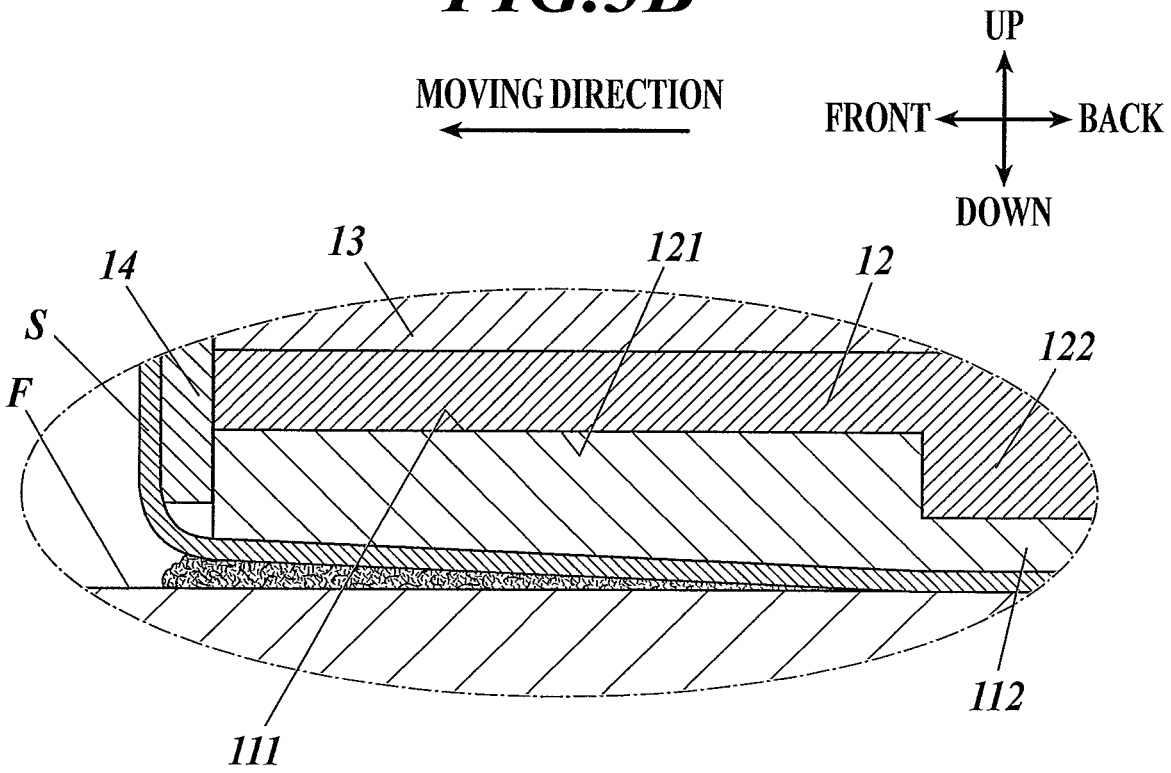
FIG. 3B is an explanatory drawing of the cleaning head of the cleaning tool in FIG. 1.

FIG. 3A shows a cross-sectional view of the cleaning head 1 along line A-A of FIG. 1 and is a schematic drawing of the state of the cleaning head 1 pressed to the side of the surface F to be cleaned. FIG. 3B shows an enlarged view of the part surrounded by a dot-dash line in FIG. 3A and is an explanatory drawing of the cleaning of the surface F to be cleaned with the cleaning head 1.

In the following explanation, the side of the surface F to be cleaned is the lower side and the opposite side of the surface F to be cleaned is the upper side. The side of one edge of the cleaning head 1 in the longer direction is the left side and the side of the other edge in the longer direction is the right side. The side of one edge in the shorter direction almost perpendicular to the longer direction of the cleaning head 1 is the front side and the side of the other edge in the shorter direction is the back side.

The cleaning head 1 is formed in an almost rectangular shape in a plane view with a predetermined thickness (see FIG. 1). Specifically, as shown in FIG. 2, the cleaning head 1 includes a first member 11 which is arranged on the side facing the surface F to be cleaned, a second member 12 which is arranged to abut on the upper side of the first member 11 (the opposite side of the side facing the surface F to be cleaned), and a case body 14 onto which the second member 12 is installed with an attachment member 13 and which contains the first member 11 and the second member 12 therein.

The case body 14 fully opens at the bottom end, and contains the first member 11 and the second member 12 therein, covering them from the upper side. A step part 141 which is formed in a shape of steps is formed at the front and back edges and the left and right edges of the case body 14, and the attachment member 13 in an almost flat shape is fixed inside the step part 141.

The case body 14 has a stick connection unit 143 at almost the center part of the top surface 142 which is on the opposite side of the side facing the surface F to be cleaned. Being attached onto the stick connection unit 143, the stick 2 is rotatable about the axes in the front-back and left-right directions of the cleaning head 1.

The sheet fixing units 144, . . . are arranged at the four respective corners of the top surface 142. The cleaning sheet S may be attached to the cleaning head 1 with the sections around the edges of the cleaning sheet S being fixed on the sheet fixing units 144, . . . . Specifically, the cleaning sheet S is applied to the lower surface 113 (described later) of the first member 11 of the cleaning head 1, and the sections of the cleaning sheet S not covered with the lower surface 113 are folded to the side of the top surface 142 of the case body 14 and tucked to the sheet fixing units 144, . . . to be set up (see FIG. 1, etc.).

Hereinafter, the cleaning sheet S is described.

The cleaning sheet S is formed in a rectangular shape with a long side in the longer direction of the cleaning head 1, suitable for the shape of the cleaning head 1, for example. Specifically, the size of the cleaning sheet S is, for example, 30 cm×20 cm, which is a common size.

The cleaning sheet S is a nonwoven fabric of a predetermined fiber material manufactured with a known technique such as spunlace, air through, airlaid, point bond, spunbond, and needle punch, for example. The predetermined fiber material may be, for example, cellulose fibers such as rayon, lyocell, tencel, and cotton, polyolefin fibers such as polyethylene, polypropylene, and polyvinyl alcohol, polyester fibers such as polyethylene terephthalate and polybutylene terephthalate, and polyamide fibers such as nylon. They may be used alone or in combination of two or more of them.

The second member 12 is fixed such that the whole upper surface of the second member 12 abuts on the lower surface of the attachment member 13.

Here, the second member 12 is fixed with a known predetermined adhesive agent or with screws. However, it is merely a non-limitative example and may be suitably changed accordingly.

The second member 12 is formed in an almost rectangular shape viewed from the side of the bottom surface of the cleaning head 1, for example. Specifically, the second member 12 has almost the same lengths in the front-back and left-right directions as the attachment member 13.

The lower surface 121 of the second member 12 forms a part abutting on the first member 11, and a protrusion part 122 which protrudes toward the side of the first member 11 is arranged on the lower surface 121. Specifically, the protrusion part 122 is formed such that the center part which is between the front and back edges in the front-back direction (shorter direction) and yet between the left and right edges in the left-right direction (longer direction), on the lower surface 121 of the second member 12, protrudes from the level of the front and back edges and the left and right edges to the side of the first member 11 (see FIG. 2B). The length by which the protrusion part 122 protrudes from the lower surface 121 is almost equal over the front-back and left-right directions. Accordingly, the protrusion part 122 is formed in an almost rectangular parallelepiped shape which has a predetermined width in the front-back direction and which has a long side in the left-right direction.

In FIG. 2B, the protrusion part 122 is schematically shown by a dashed line.

Here, the cleaning head 1 is used to wipe the surface F to be cleaned by moving in a predetermined direction (ex. to the front, etc.) on the surface F to be cleaned. More specifically, the cleaning head 1 is used to wipe the surface F to be cleaned by moving to and fro in one direction (ex. to the front, to the left, etc.) and in the other direction opposite to that direction (ex. to the back, to the right, etc.) on the surface F to be cleaned. That is, the cleaning head 1 may be used to wipe the surface F to be cleaned by moving to and fro in almost the same direction as the shorter direction (front-back direction) or in the longer direction (left-right direction).

The protrusion part 122 is formed on the upstream side of the edge of the lower surface 121 of the second member 12 in the moving direction of the cleaning head 1 (ex. in a case where the moving direction is to the front, on the back side compared to the front edge) and protrudes toward the side of the first member 11 more than the edge in the moving direction. That is, the protrusion part 122 is formed by the center part of the lower surface 121 of the second member 12 between the both edges (ex. front and back edges or left and right edges) in the to-and-fro moving direction.

The second member 12 is a member relatively more rigid than the first member 11 (described later). Specifically, the second member 12 is formed with thermoplastic resin such as polypropylene (PP), for example, while the first member 11 is formed with styrene or olefin thermoplastic elastomer, polyurethane resin, ethylene vinyl acetate polymer (EVA), etc., for example.

The materials which the first member 11 and the second member 12 are made of are preferably selected in consideration of the extent of deformation of the first member 11 in a state where the cleaning head 1 is pressed to the side of the surface F to be cleaned, as described later. For example, there may be multiple first members 11 which are formed with compositions different from each other and which are replaceable according to the purpose of cleaning.

The first member 11 is formed in an almost rectangular shape viewed from the side of the bottom surface of the cleaning head 1, for example. Specifically, the first member 11 has lengths in the front-back and left-right directions almost equal to those of the second member 12. Accordingly, the first member 11 and the second member 12 are layered in the up-down direction and contained inside the case body 14.

The upper surface 111 of the first member 11 forms a part abutting on the second member, and a recess part 112 which fits the protrusion part 122 of the second member 12 is arranged on the upper surface 111. Specifically, the recess part 112 is formed such that the upper surface 111 hollows to the side facing the surface F to be cleaned between the front and back edges in the front-back direction (shorter direction) and yet between the left and right edges in the left-right direction (longer direction) of the upper surface 111 of the first member 11.

Accordingly, the recess part 112 is formed in a recessed shape which has a predetermined width in the front-back direction, a longer side in the left-right direction, and almost equal depths in the front-back and left-right directions. Specifically, the width of the recess part 112 in the front-back direction is almost equal to or slightly larger than that of the protrusion part 122 in the front-back direction. The width of the recess part 112 in the left-right direction is almost equal to or slightly larger than that of the protrusion part 122 in the left-right direction. The depth of the recess part 112 is almost equal to or slightly larger than the length by which the protrusion part 122 protrudes.

Here, in a case where the cleaning head 1 is moved to and fro in almost the same direction as the shorter direction (front-back direction) or the longer direction (left-right direction) for wiping the surface F to be cleaned, the recess part 112 which fits the protrusion part 122 of the second member 12 is arranged on the upstream side of the edge of the upper surface 111 of the first member 11 in the moving direction of the cleaning head 1 (ex. in a case where the moving direction is to the front, on the back side compared to the front edge). That is, the recess part 112 is formed between the both edges (ex. front and back edges or left and right edges) in the to-and-fro moving direction on the upper surface 111 of the first member 11.

The first member 11 and the second member 12 are fixed together with a known predetermined adhesive agent on the surfaces which abut on each other (the upper surface 111 of the first member 11 and the lower surface 121 of the second member 12, and the upper surface of the recess part 112 and the lower surface of the protrusion part 122) in a state where the protrusion part 122 of the second member 12 fits in the recess part 112 of the first member 11, for example. However, it is merely a non-limitative example and may be suitably changed accordingly.

The lower surface 113 of the first member 11 facing the surface F to be cleaned is formed in a plane shape. Thus, in a state where the cleaning head 1 touches the surface F to be cleaned with the cleaning sheet S in between but is not pressed to the side of the surface F to be cleaned (see FIG. 2A), for example, the whole bottom surface (surface for cleaning) of the cleaning sheet S attached onto the cleaning head 1 facing the surface F to be cleaned may touch the surface F to be cleaned.

On the other hand, in a state where the cleaning head 1 is pressed to the side of the surface F to be cleaned (see FIGS. 3A and 3B) in cleaning, for example, the first member 11 is easier to be deformed because the second member 12 is a member relatively more rigid than the first member 11. Here, as the thickness (length in the up-down direction) of the first member 11 gets smaller in an area corresponding to the recess part 112 by the thickness of the protrusion part 122 of the second member 12, the first member 11 deforms less freely in the up-down direction compared to the area other than the recess part 112 such as the front and back edges in the front-back direction and the left and right edges in the left-right direction on the upper surface ill. Accordingly, as the pressure to be added onto the surface F to be cleaned increases, almost the whole area corresponding to the recess part 112 on the lower surface 113 of the first member 11 may touch the surface F to be cleaned with the cleaning sheet S in between and, on the other hand, there may be more interspace between the cleaning sheet S and the surface F to be cleaned at the front and back edges in the front-back direction and the left and right edges in the left-right direction where the surface F to be cleaned is more separate from the surface F to be cleaned.

<Usage of the Cleaning Tool>

Next, the usage of the cleaning tool 100 is described.

The user does the cleaning by moving the cleaning head 1 to and fro in almost the same direction as the shorter direction (front-back direction) in the following description.

First, the user attaches the cleaning sheet S onto the cleaning head 1. When attached, the cleaning sheet S is inserted into the sheet fixing unit 144 preferably such that there is no space between the lower surface 113 of the first member 11 and the area of the cleaning head 1 where touching the lower surface 113 and such that the area of the cleaning sheet S sticking out of the lower surface 113 and folded back is not remaining.

After that, as the user grips the stick 2 of the cleaning tool 100 onto which the cleaning sheet S is attached and moves the cleaning head 1 in one direction (ex. to the front) on the surface F to be cleaned like a mop (see FIG. 3A), pressure is added to the cleaning head 1 diagonally downward in the moving direction and the cleaning head 1 is pressed to the surface F to be cleaned. In that state, the lower surface 113 of the first member 11 is more separate from the surface F to be cleaned at the front edge to which the moving direction is directed and interspace is generated between the cleaning sheet S and the surface F to be cleaned. Almost the whole area corresponding to the recess part 112 on the lower surface 113 of the first member 11 touches the surface F to be cleaned with the cleaning sheet S in between.

As the cleaning head 1 is moved in the one direction on the surface F to be cleaned, dusts and dirt on the surface F to be cleaned get into the interspace between the cleaning sheet S and the surface F to be cleaned and are caught by the cleaning sheet S to be removed.

In a state where the cleaning head 1 is pressed to the surface F to be cleaned, interspace is generated between the cleaning sheet S and the surface F to be cleaned also on the side of the left and right edges in the left-right direction on the lower surface 113 of the first member 11, but the interspace is not actively used for removal of dusts and dirt on the surface F to be cleaned as it is in the direction almost perpendicular to the moving direction of the cleaning head 1.

Though not shown in the drawings, in a case where the cleaning head 1 is moved in the other direction (ex. to the back) which is opposite to the one direction on the surface F to be cleaned in the to-and-fro movement of the cleaning head 1, pressure is added to the cleaning head 1 diagonally downward in the moving direction and the cleaning head 1 is pressed to the surface F to be cleaned, in the same way. The lower surface 113 of the first member 11 is more separate from the surface F to be cleaned at the back edge to which the moving direction is directed and interspace develops between the cleaning sheet S and the surface F to be cleaned.

As the cleaning head 1 is moved in the other direction on the surface F to be cleaned, dusts and dirt on the surface F to be cleaned get into the interspace between the cleaning sheet S and the surface F to be cleaned and are caught by the cleaning sheet S to be removed.

As described above, the cleaning tool 100 according to the present embodiment is as follows. The first member 11 is arranged on the side facing the surface F to be cleaned. The second member 12 which is arranged to abut on the first member 11 on the opposite side of the side facing the surface F to be cleaned is a member relatively more rigid than the first member 11. The second member 12 has the protrusion part 122 on the upstream side of the edge of a part (lower surface 121) abutting on the first member 11 in the moving direction of the cleaning head 1. The protrusion part 122 protrudes toward the side of the first member 11 more than the edge in the moving direction. As the surface on the side facing the surface F to be cleaned of the first member 11 is formed in a plane shape and the first member 11 has the recess part 112 which fits the protrusion part 122 on the upstream side of a part (upper surface 111) abutting on the second member 12 in the moving direction of the cleaning head. Thus, in a state where the cleaning head 1 is pressed to the side of the surface F to be cleaned when the cleaning head 1 is moved in a predetermined direction on the surface F to be cleaned for wiping the surface F to be cleaned, the lower surface 113 of the first member 11 is more separate from the surface F to be cleaned at the edge to which the moving direction is directed and interspace is generated between the cleaning sheet S and the surface F to be cleaned. Dusts and dirt on the surface F to be cleaned get into the interspace and are caught to be removed by the cleaning sheet S.

As described above, in a state where the cleaning head 1 is pressed to the side of the surface F to be cleaned, the area on the upstream side of the edge of the lower surface 113 of the first member 11 in the moving direction (closer to the center) may contribute to removal of dusts and dirt, which enables efficient cleaning of the surface F to be cleaned.

Specifically, an area of the second member 12 between the both edges of the part (lower surface 121) abutting on the first member 11 in the to-and-fro moving direction protrudes toward the side of the first member 11 more than the both edges to form the protrusion part 122. The first member 11 has the recess part 112 between the both edges of the part (upper surface 111) abutting on the second member 12 in the to-and-fro moving direction. Thus, in a state where the cleaning head is pressed to the side of the surface F to be cleaned, the area between the both edges in the to-and-fro moving direction (closer to the center) on the lower surface 113 of the first member 11 may contribute to removal of dusts and dirt, which enables efficient cleaning of the surface F to be cleaned.

The present invention is not limited to the above embodiment, and various kinds of improvement or modifications of the structure may be made without departing from the scope of the invention.

Hereinafter, modification examples of the cleaning tool 100 are described. The cleaning tool 100 in the modification examples have the same configuration and function as the above embodiment except for the features described below, and the detailed descriptions of the common features are omitted.

MODIFICATION EXAMPLE 1

Hereinafter, the cleaning head 1A in the modification example 1 is described with reference to FIGS. 4A and 4B.

Figure 4A:
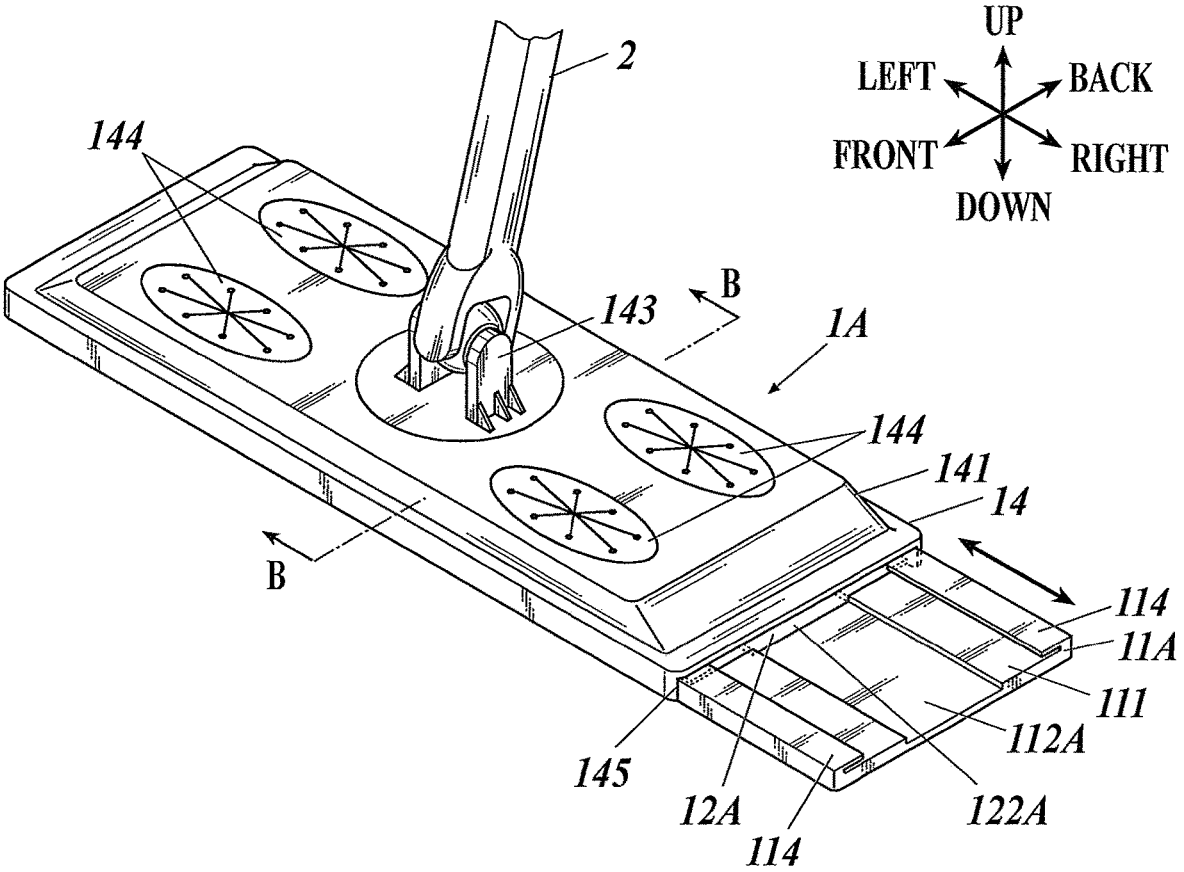
FIG. 4A is an explanatory drawing of a cleaning head in the first modification example.
Figure 4B:
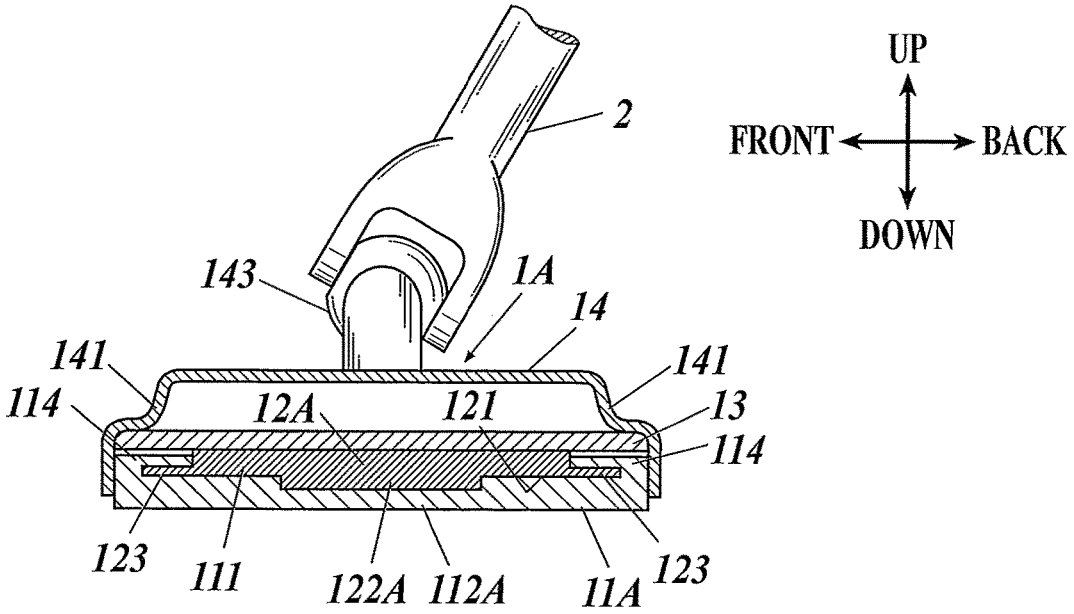
FIG. 4B is an explanatory drawing of a cleaning head in the first modification example.

FIG. 4A shows a perspective view of the cleaning head 1A in the modification example 1, and FIG. 4B shows a sectional view of the cleaning head 1A along line B-B of the FIG. 4A. In FIGS. 4A and 4B, the cleaning sheet S is not included in the drawings.

The cleaning head 1A in the modification example 1 is configured such that the first member 11A may be detachably attached to the second member 12A, as shown in FIGS. 4A and 4B.

In the modification example 1, the cleaning head 1A is supposed to be used in the cleaning by moving to and fro in almost the same direction as the shorter direction (front-back direction). However, it is merely a non-limitative example, and the shape or such of the first member 11A and the second member 12A may be suitably changed according to the moving direction of the cleaning head 1A.

For example, a flanged catch 123 with a predetermined thickness is formed along the left-right direction at each of the front and back edges of the second member 12A in the front-back direction. A protrusion part 122A is formed over the left and right edges of the second member 12A in the left-right direction.

On the other hand, a hook-shaped latch 114 corresponding to the shape of the catch 123 is formed along the left-right direction at each of the front and back edges of the first member 11A along the front-back direction, for example. The cross-sectional shape viewed from the right at the front edge of the latch 114 is angular U tilted 90 degrees to the right, and the cross-sectional shape viewed from the right at the back edge of the latch 114 is angular U tilted 90 degrees to the left, for example. A recess part 112A is formed over the left and right edges of the first member 11A in the left-right direction.

An opening 145 is formed on the right lateral surface of the case body 14 and movable space for the first member 11A which is attached and detached to and from the second member 12A is kept.

According to the modification example 1, the first member 11A may be attached and detached to and from the second member 12A more easily, when the first member 11 is changed to a desirable one among multiple prepared ones according to the usage of cleaning or changed from a used one to a new one, for example.

The first member 11A is configured to be detachably attached to the second member 12A in the above description, but it is merely a non-limitative example. For example, instead of the configuration with the catch 123 and the latch 114 described above or the adhesion in the above embodiment, the inner size of the recess part is slightly smaller than or almost equal to the outer size of the protrusion part so that the first member may be attached to the second member by the friction between the outer surface of the protrusion part and the inner surface of the recess part.

MODIFICATION EXAMPLE 2

Hereinafter, the cleaning head 1B in the modification example 2 is described with reference to FIGS. 5A and 5B.

Figure 5A:
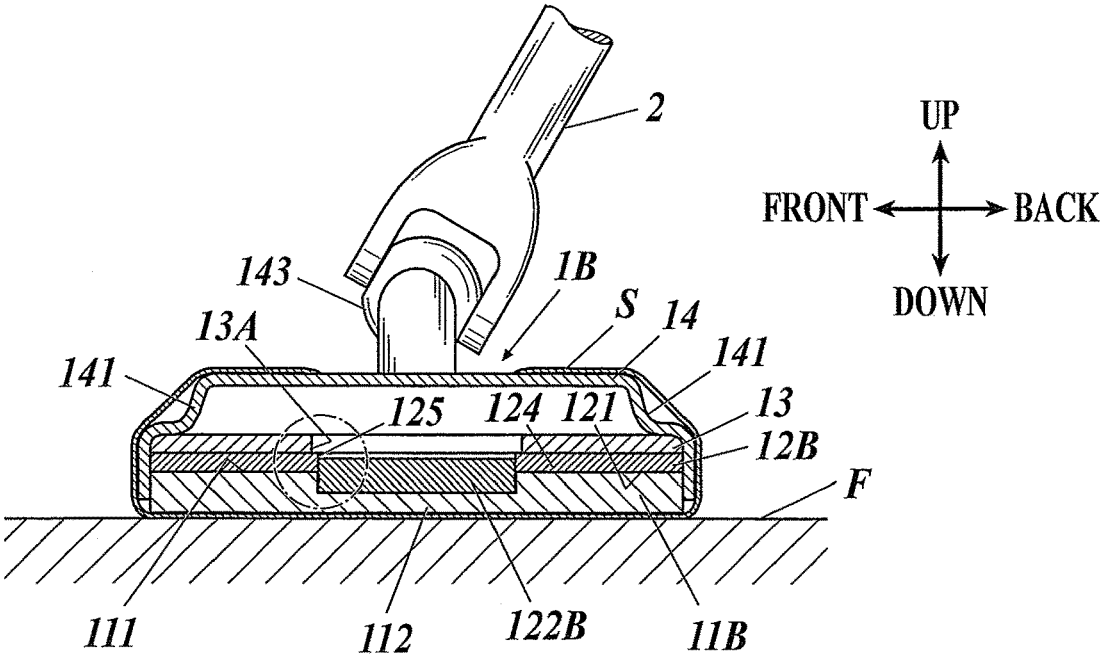
FIG. 5A is an explanatory drawing of a cleaning head in the second modification example.

FIG. 5A shows a cross-sectional view of the cleaning head 1B of the modification example 2 along line A-A of FIG. 1. FIG. 5B shows an enlarged view of the part surrounded by a dot-dash line in FIG. 5A.

Figure 5B:
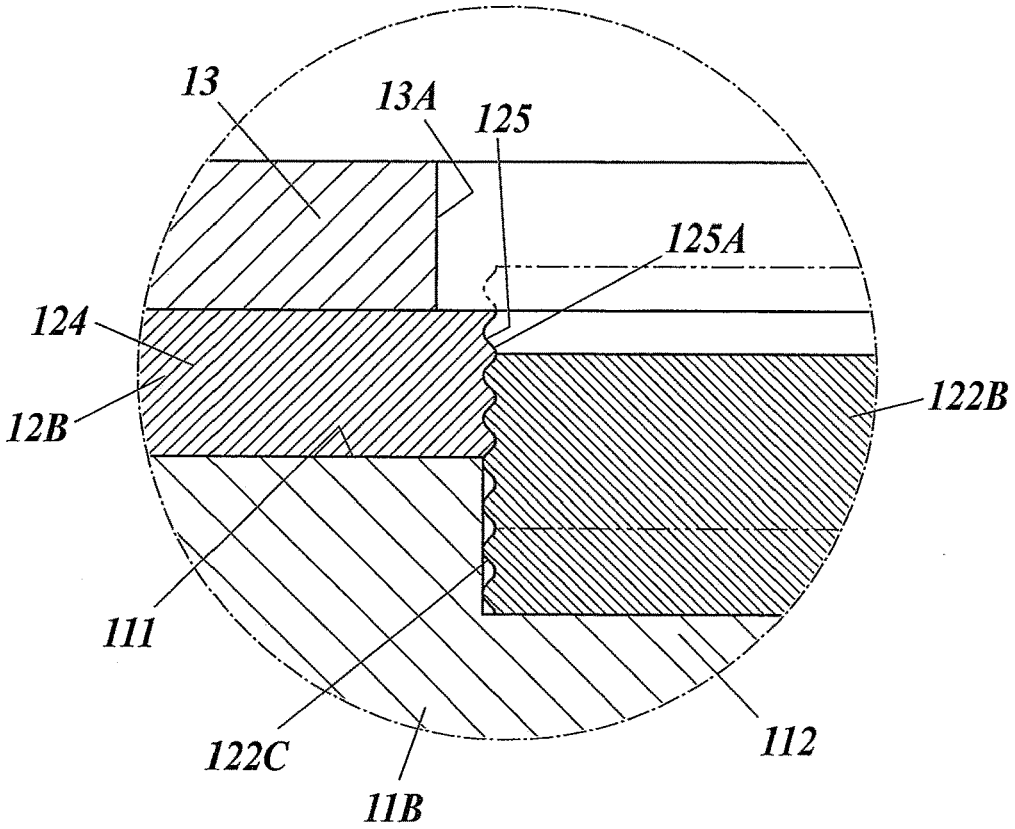
FIG. 5B is an explanatory drawing of the cleaning head in the second modification example.

The cleaning head 1B of the modification example 2 is configured such that the length by which the protrusion part 122B of the second member 12B protrudes may be suitably adjusted, as shown in FIGS. 5A and 5B.

That is, the second member 12B is formed by a main body 124 and the protrusion part 122B which are separate, and the position for attaching the protrusion part 122B on the main body 124 may be adjusted in the up-down direction.

Specifically, an opening 125 is formed at almost the center part of the main body 124, and a wavy part 125A is formed on the inner peripheral of the opening 125. The protrusion part 122B has an outer shape almost the same as the inner shape of the opening 125, and the wavy part 122C is formed on the outer peripheral of the protrusion part 122B.

The wavy part 125A of the opening 125 of the main body 124 and the wavy part 122C of the protrusion part 122B are formed in shapes which mesh with each other, and the position for engagement may be suitably adjusted (see FIG. 5B). For example, in a case where the length by which the protrusion part 122B protrudes is to be smaller (shortened), the protrusion part 122B is moved upward relative to the main body 124 as the first member 11B is detached from the second member 12B and the protrusion part 122B is pressed upward from the lower surface of the protrusion part 122B. On the other hand, in a case where the length by which the protrusion part 122B protrudes is to be extended (longer), the protrusion part 122B is moved downward relative to the main body 124 as the second member 12B is detached from the attachment member 13 and the protrusion part 122B is pressed downward from the side of the upper surface of the protrusion part 122B.

The state where the protrusion part 122B is moved upward relative to the main body 124 is schematically shown by a dash-dot-dot line in FIG. 5B.

In a case where the first member 11B is detached from the second member 12B or the second member 12B from the attachment member 13, it is preferred that each unit be attached again with adhesion or such. Alternatively, with an operation unit (not shown in the drawings) to adjust the position of the protrusion part 122B in the up-down direction from the outer side of the case body 14, it is unnecessary for the first member 11B and the second member 12B to be detached or to be attached again as described above.

An opening 13A is formed at the position corresponding to the protrusion part 122B of the attachment member 13 or the opening 125 of the main body 124 and movable space for the protrusion part 122B to move upward relative to the main body 124 is kept.

According to the modification example 2, the length by which the protrusion part 122B protrudes may be adjusted according to the usage in cleaning, for example. Thus, it is possible to adjust the interspace generated between the cleaning sheet S and the surface F to be cleaned as the edge of the lower surface 113 of the first member 11B in the moving direction is separated from the surface F to be cleaned in the state where the cleaning head 1B is pressed to the side of the surface F to be cleaned. Accordingly, the extent to which dusts and dirt on the surface F to be cleaned easily gets in the interspace between the cleaning sheet S and the surface F to be cleaned may be adjusted, and the cleaning sheet S may efficiently catch the dusts and dirt to be removed.

The shapes and positions of the protrusion part 122 and the recess part 112 exemplified in the embodiment and modification examples above are merely non-limitative examples and may be suitably changed accordingly.

FIGS. 6A to 6G are schematic drawings of modification examples of the protrusion part 122 and the recess part 112, and show cross-sectional views along line A-A of FIG. 1. FIGS. 7A to 7E show bottom views of the second member 12, in which modification examples of the protrusion part 122 are schematically shown.

Figure 6A:
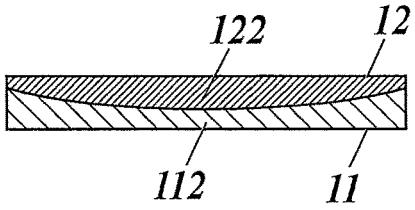
FIG. 6A is an explanatory drawing of a modification example of a protrusion part and a recess part.
Figure 6B:
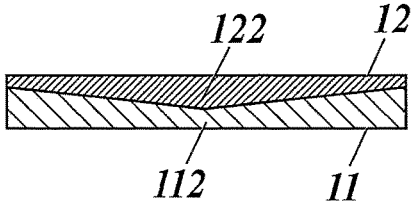
FIG. 6B is an explanatory drawing of a modification example of the protrusion part and the recess part.
Figure 6C:
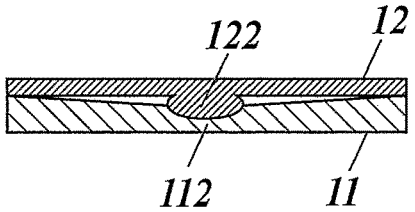
FIG. 6C is an explanatory drawing of a modification example of the protrusion part and the recess part.
Figure 6D:
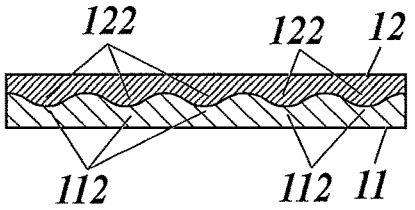
FIG. 6D is an explanatory drawing of a modification example of the protrusion part and the recess part.
Figure 6E:
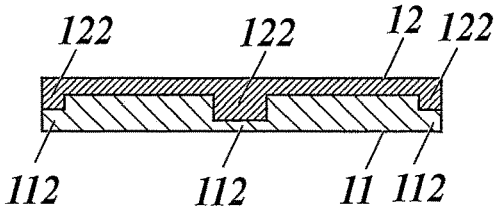
FIG. 6E is an explanatory drawing of a modification example of the protrusion part and the recess part.
Figure 6F:
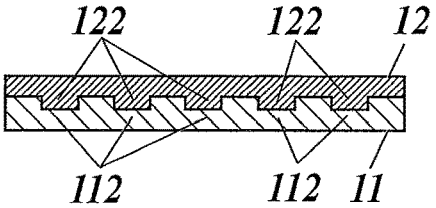
FIG. 6F is an explanatory drawing of a modification example of the protrusion part and the recess part.
Figure 6G:
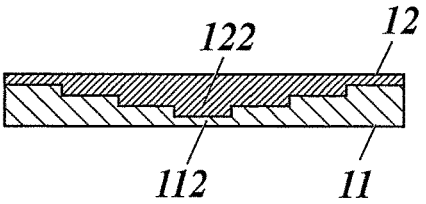
FIG. 6G is an explanatory drawing of a modification example of the protrusion part and the recess part.

For example, the protrusion part 122 may be formed in an arc shape protruding downward, and the recess part 112 may be formed in a recessed shape corresponding to the shape of that protrusion part 122 (see FIG. 6A). The protrusion part 122 may be formed in a shape pointed at the lower edge (end part), and the recess part 112 may be formed in a recessed shape corresponding to the shape of that protrusion part 122 (see FIG. 6B). The protrusion part 122 may be formed in a cross-sectional shape with a part of an ellipse, and the recess part 112 may be formed in a recessed shape corresponding to the shape of the lower edge (end part) of that protrusion part 122. In such a case, interspace is generated between the upper surface of the first member 11 and the lower surface of the second member 12. (See FIG. 6C.) There may be multiple protrusion parts 122 formed in a cross-sectional wavy shape, and recess parts 112 may be formed in a recessed shape corresponding to the shape of those protrusion parts 122 (see FIG. 6D). The protrusion part 122 may be formed at each of the front and back edges and almost the center part, where the length by which the protrusion part 122 protrudes is smaller at the front and back edges and larger at almost the center part. The recess parts 112 may be formed in recessed shapes corresponding to the shape of those protrusion parts 122 (see FIG. 6E). There may be multiple protrusion parts 122 formed in a cross-sectional shape of rectangle, and recess parts 112 may be formed in a recessed shape corresponding to the shape of those protrusion parts 122 (see FIG. 6F). The protrusion part 122 may be formed in a shape of steps, where the length by which a step of the protrusion part 122 protrudes is longer as approaching the center in the front-back direction, and the recess part 112 may be formed in a recessed shape corresponding to the shape of the protrusion part 122 (see FIG. 6G).

Figure 7A:
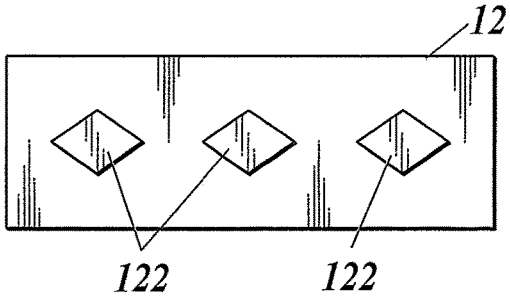
FIG. 7A is an explanatory drawing of a modification example of the protrusion part.
Figure 7B:
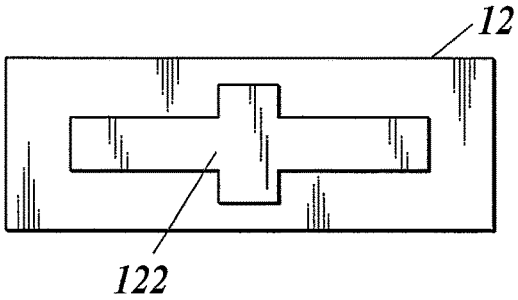
FIG. 7B is an explanatory drawing of a modification example of the protrusion part.
Figure 7C:
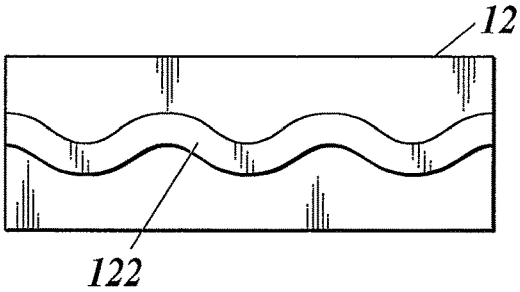
FIG. 7C is an explanatory drawing of a modification example of the protrusion part.
Figure 7D:
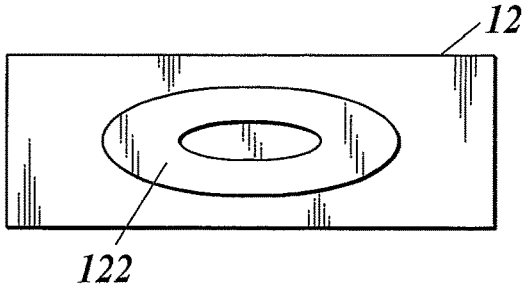
FIG. 7D is an explanatory drawing of a modification example of the protrusion part.
Figure 7E:
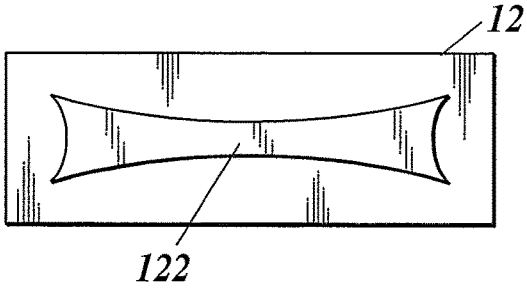
FIG. 7E is an explanatory drawing of a modification example of the protrusion part.

There may be multiple (ex. three) protrusion parts 122 in a diamond shape in a plan view formed along the left-right direction of the second member 12 (see FIG. 7A). The protrusion part 122 in a cross shape which is horizontally long in a plan view may be formed (see FIG. 7B). The protrusion part 122 in a wavy shape in a plan view may be formed along the left-right direction of the second member 12 (see FIG. 7C). The protrusion part 122 in a shape of an oblong ring in a plan view may be formed (see FIG. 7D). The protrusion part 122 in a shape of combined arced curves protruding to the center in the front-back and left-right directions may be formed (see FIG. 7E).

The configuration of the cleaning head 1, 1A, or 1B is merely a non-limitative example. For example, the attachment member 13 is not necessarily installed and the second member 12, 12A, or 12B may be directly attached inside the case body 14.

In the embodiment and modification examples described above, the cleaning head 1 is employed in the cleaning where it is moved to and fro on the surface F to be cleaned for wiping the surface F to be cleaned, but it is merely a non-limitative example. For example, the cleaning head 1 may be configured to move in one predetermined direction on the surface F to be cleaned for wiping the surface F to be cleaned.

INDUSTRIAL APPLICABILITY

The present invention is suitably applicable for the manufacturing field of a cleaning head and a cleaning tool.

REFERENCE SIGNS LIST

100 Cleaning Tool
1, 1A, 1B Cleaning Head
11, 11A, 11B First Member
11 Upper Surface (Abutting Part)
112, 112A Recess Part
12, 12A, 12B Second Member
121 Lower Surface (Abutting Part)
122, 122A, 122B Protrusion Part
1 Stick
S Cleaning Sheet

The invention claimed is:

1. A cleaning head onto which a cleaning sheet for wiping a surface to be cleaned is attached and which is movable on the surface to be cleaned in a predetermined direction for wiping the surface to be cleaned, the cleaning head comprising:

a first member having a side facing the surface to be cleaned;

a second member abutting on at least a portion of the first member on a side of the first member opposite the side facing the surface to be cleaned; and a case body that contains the first member and the second member therein, the case body covering the first member and the second member from an upper side, wherein the case body comprises a stick connection unit and a sheet fixing unit on the upper side, wherein the first member is disposed in the case body between the surface to be cleaned and the second member, wherein the second member is more rigid than the first member, wherein the second member has a protrusion part provided at a position upstream of an edge of a part of the second member that abuts on the first member in a moving direction of the cleaning head, the protrusion part protruding in a direction toward the first member beyond the edge of the part of the second member that abuts on the first member, wherein a surface of the first member on the side facing the surface to be cleaned has a planar shape, and wherein the first member has a recess part, in which the protrusion part of the second member is received, at a position upstream of an edge of a part of the first member on which the second member abuts in the moving direction of the cleaning head.

2. The cleaning head according to claim 1, wherein the cleaning head is movable to and fro in a first direction and in a second direction opposite to the first direction on the surface to be cleaned for wiping the surface to be cleaned, wherein a part of the second member protrudes in the direction toward the first member beyond both edges of the part of the second member that abuts on the first member to form the protrusion part between the both edges in a to-and-fro moving direction, and wherein the recess part is provided between the both edges in the to-and-fro moving direction.

3. The cleaning head according to claim 2, wherein the cleaning head is movable in a direction substantially the same as a shorter direction which is substantially perpendicular to a longer direction of the cleaning head for wiping the surface to be cleaned, wherein the protrusion part is provided between both edges of the part of the second member that abuts on the first member in the shorter direction, and wherein the recess part is provided between the both edges in the shorter direction.

4. The cleaning head according to claim 3, wherein the cleaning head is further movable in a direction substantially the same as the longer direction for wiping the surface to be cleaned, wherein the protrusion part is provided between both edges of the part of the second member that abuts on the first member in the longer direction, and wherein the recess part is provided between the both edges in the longer direction.

5. The cleaning head according to claim 4, wherein the first member is detachably attached to the second member.

6. The cleaning head according to claim 4, wherein a length by which the protrusion part protrudes is adjustable.

7. The cleaning head according to claim 3, wherein a length by which the protrusion part protrudes is adjustable.

8. The cleaning head according to claim 3, wherein the first member is detachably attached to the second member.

9. The cleaning head according to claim 2, wherein the first member is detachably attached to the second member.

10. The cleaning head according to claim 2, wherein a length by which the protrusion part protrudes is adjustable.

11. The cleaning head according to claim 1, wherein the cleaning head is movable in a direction substantially the same as a shorter direction which is substantially perpendicular to a longer direction of the cleaning head for wiping the surface to be cleaned, wherein the protrusion part is provided between both edges of the part of the second member that abuts on the first member in the shorter direction, and wherein the recess part is provided between the both edges in the shorter direction.

12. The cleaning head according to claim 11, wherein the cleaning head is further movable in a direction substantially the same as the longer direction for wiping the surface to be cleaned, wherein the protrusion part is provided between both edges of the part of the second member that abuts on the first member in the longer direction, and wherein the recess part is provided between the both edges in the longer direction.

13. The cleaning head according to claim 12, wherein the first member is detachably attached to the second member.

14. The cleaning head according to claim 12, wherein a length by which the protrusion part protrudes is adjustable.

15. The cleaning head according to claim 11, wherein the first member is detachably attached to the second member.

16. The cleaning head according to claim 11, wherein a length by which the protrusion part protrudes is adjustable.

17. The cleaning head according to claim 1, wherein the first member is detachably attached to the second member.

18. The cleaning head according to claim 17, wherein a length by which the protrusion part protrudes is adjustable.

19. The cleaning head according to claim 1, wherein a length by which the protrusion part protrudes is adjustable.

20. A cleaning tool comprising:

the cleaning head according to claim 1; and a stick connected to the cleaning head on a side of the cleaning head opposite to a side of the cleaning head facing the surface to be cleaned.

* * * * *